United States Patent [19]

Walker

[11] 4,048,912

[45] Sept. 20, 1977

[54] COLOR SPRAY BOOTH AND METHOD OF VENTILATING THE SAME

[75] Inventor: George Walker, Staines, England

[73] Assignee: AB Svenska Flaktfabriken, Nacka, Sweden

[21] Appl. No.: 615,971

[22] Filed: Sept. 19, 1975

[30] Foreign Application Priority Data

Sept. 19, 1974 Sweden ..... 7411766

[51] Int. Cl.[2] ..... F23J 11/00

[52] U.S. Cl. ..... 98/115 SB; 55/385 A; 55/DIG. 29; 98/36; 118/326; 118/634; 118/DIG. 7

[58] Field of Search ..... 98/36, 115 R, 115 SB; 118/326, 634, DIG. 7; 55/385 A, DIG. 29

[56] References Cited

U.S. PATENT DOCUMENTS

| | | | |
|---|---|---|---|
| 2,119,282 | 5/1938 | Ludwig | 98/115 SB |
| 2,730,033 | 1/1956 | Mellor | 98/115 SB |
| 3,168,030 | 2/1965 | Wilhelmsson et al. | 98/115 SB |
| 3,254,588 | 6/1966 | Truhan | 98/36 X |
| 3,380,369 | 4/1968 | Allander | 98/36 |
| 3,726,204 | 4/1973 | Lindestrom | 98/36 |
| 3,834,293 | 9/1974 | Danieli | 98/36 |

*Primary Examiner*—Ronald C. Capossela
*Attorney, Agent, or Firm*—Howson and Howson

[57] ABSTRACT

A ventilated enclosure, for example a paint-spraying booth, is divided into two or more zones by one or more isolating curtains of rapidly-flowing air. One longitudinal curtain is used on each side of the object to be treated in the enclosure, to provide a central longitudinal zone for the surface treatment process and two side zones for the workmen. The two curtains converge downwardly toward each other so that the ventilating air flowing downwardly between the curtains exits from the central zone largely by way of the space between said objects. Transverse curtains and/or additional longitudinal curtains may also be used with special advantages, particularly when the speeds and positions of the curtains are specially selected.

7 Claims, 1 Drawing Figure

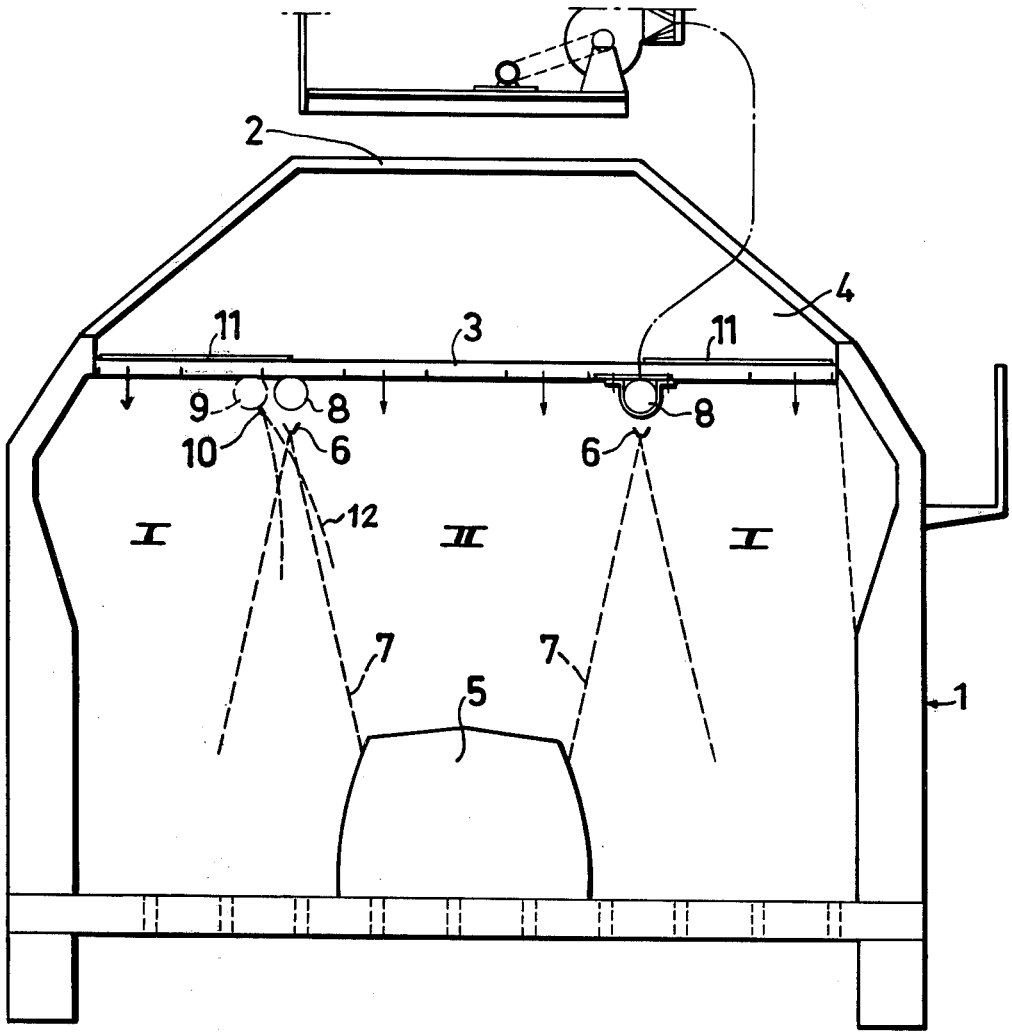
2
4
11
3
11
9
8
8
10
6
6
12
I
II
I
7
7
5
1

COLOR SPRAY BOOTH AND METHOD OF VENTILATING THE SAME

The invention relates to a surface treatment plant in which objects to be treated and/or coated, are placed in, or conveyed through, either continously or intermittently, an enclosure, booth, chamber or tunnel, and a method for ventilating such enclosure booth or tunnel. It is to be understood that in this specification the expression surface treatment plant includes enclosures, booths, chambers, and tunnels together with means for liquid painting by brushing or spraying, the application of surface coatings by solid means such as powder, scuffing and grinding operations, other pretreatment, and after-treatment product heating and cooling plant, together with a ventilation means.

For example, paint spray booths often form part of a production line for the manufacture of products such as car bodies. Fully assembled or partly completed car bodies are usually conveyed by a conveyor into a room or tunnel forming part of the booth and a desired colour or colours is or are applied by spraying paint onto the bodies either manually or automatically. In manual spraying suitably clad personnel working in the booth direct paint spray equipment towards the bodies which are to be painted. Gases and fumes as well as paint sprays and mists, are released during the spraying operation and these are injurious to health. An effective ventilation system for the personnel and the operation of the booths is thus required.

It is also often desirable to be able to apply different colours or shades to different products passing through a booth. Therefore it is important that cross-contamination of colours is avoided by preventing paint drifting from one spray station to another within the booth.

Various booths have been devised in an attempt to provide a paint spray booth which avoids the health hazards and provides for a control of the spraying operations. In prior booths there is an air inlet in the ceiling through which inlet very large quantities of air are conducted into the booth. This air exits from the booth through an outlet arranged in the floor or elsewhere, the mist fumes paint dust and the like being swept out of the booth by the air and are expelled simultaneously. If the air inlet quantity is insufficient it often tends to cause undesirable turbulence, and randomly directed air streams are formed which carry mist fumes paint dust etc. to undesirable zones of the booth. To avoid turbulence the air is passed into the booth with a relatively high velocity. It will however be understood that a booth for painting, for example, car bodies has a relatively large volume. Such a booth might for example be 20–30 metres long, 4–5 metres wide and 3–5 metres high. The ventilation air will be conveyed in at normal working temperatures e.g. in the range 19°/23° C. For health reasons full fresh external air is normally used for the ventilation so that in winter very low temperatures for example −20° C need to be increased to the temperate condition. Therefore it will be understood that enormous amounts of energy are required to provide the necessary high volume of relatively high velocity temperate air over the whole of the booth from ceiling to floor. Also from a practical aspect it is not possible to ventilate differentially to any significant degree in the prior booths, without partitioning the booths.

The invention therefore seeks to mitigate these disadvantages of the prior art.

According to one aspect of the invention there is provided an enclosure, booth, chamber or tunnel forming part of a surface treatment plant for treating a surface of an object or objects, comprising means to supply ventilating air to the enclosure, booth, chamber or tunnel, and exit for the ventilating air, and a means to provide at least one curtain of air which can define at least two zones in the enclosures, booth, chamber or tunnel.

According to a second aspect of the invention there is provided a method of ventilating an enclosure, booth, chamber or tunnel forming part of a surface treatment plant for treating a surface of an object or objects, comprising feeding fresh ventilating air to the enclosure, booth, chamber or tunnel, carrying the ventilating air, contaminated with mists, fumes, paint, dust and the like, through an exit, and defining within the enclosure, booth, chamber or tunnel, at least two zones by means of at least one air curtain, each curtain of air having a relatively high velocity in relation to that of the ventilating air.

One construction embodying the invention, in the following description comprising a paint spray for painting car bodies, is diagrammatically illustrated by way of example, in the accompanying drawing, which shows a vertical cross-section of the paint spray booth.

Referring to the drawing there is shown a paint spray booth 1. Below a roof 2 of the booth 1 there is a ceiling 3 which is designed to provide air inlet. A blower or a multiplicity of blowers (not shown) is arranged to supply the ventilating air to the space between the roof 2 and ceiling 3 for passage in the direction of the arrows through the ceiling 3 into the chamber or tunnel of the booth. The ingoing ventilating air is maintained temperate by means not shown in the drawing. Furthermore a floor of the booth is provided with air outlets through which the used air carrying mists, fumes, paint, dust and the like are removed from the booth. The booth has a relatively large length and a conveyor extends longitudinally through the booth. Objects which are to be spray painted, for example bodies 5, are placed on the conveyor (not shown). The car bodies are spaced apart on the conveyor.

Nozzles 6 are arranged on both sides of the products' path of movement through the paint spray chamber within or below the ceiling 3. The nozzles 6 are suitably of the jet nozzle kind, and can direct a stream of air with a relatively high speed against the area immediately adjacent to the car bodies' path of movement and towards the side edges of the car bodies. The nozzles 6 are distributed evenly and preferably closely spaced apart over the length of the spray chamber, so that a continuous curtain of air 7 is formed along each longitudinal side of each car body as the bodies move through the paint spray chamber. Instead of the jet nozzles 6, openings or like vents in the ceiling 3 or in specially provided conduits can also be utilised. The air for forming the curtains of air 7 can be supplied by pipes or like conduits 8 mounted, for example, underneath in or above the ceiling 3.

It will be understood that the curtains of air 7 divide the inside of the spray chamber into three zones, namely, two longitudinal zones I, located at the sides and one central longitudinal zone II, which are effectively separated from one another by the curtains of air 7. The zones I are each for working personnel, and the zone II is for the objects, in this case the car bodies 5. The curtains of air 7 which are in the form of jets can be given any desired speed, which speed can vary as required depending on the different conditions to be obtained in the chamber. For example the initial velocity can be about 10m/sec at the ceiling fallint to 0.5m/sec in the vicinity of the floor.

It is also possible to vary speeds of the air within the three zones, I,I and II. For example initial velocities at the ceiling in the zones I may be 0.15–0.2 m/sec, and the initial velocity at the ceiling may be 0.5 m/sec in the zone II. The initial velocity in the zones I can be reduced for example to 0.1 m/sec in the vicinity of the outlet. The air in the product zone II, is arranged to flow with such a speed that it is prevented from streaming along the sides of the bodies parallel with their path of movement due to the air pressure wall built up by each of the curtains. As a result of this, a reduction of the velocity of the air in the area above, especially over the bodies is obtained. As the bodies effectively screen off a significant part of the outflow area for the air in the floor, only the space between the bodies is consequently available for removal of the ventilating air in the zone II. Therefore zones of increasing air speed are obtained within the areas between the bodies. The air speed in these zones can have a value which is a median of that of the entrance and the exit speed, or can equal the speed of entrance, or even exceed the speed of entrance through the ceiling.

To increase air speed within the zone II, and between the bodies, a modified embodiment has air inlets 9 of which only one is shown, although such inlets would in practice be positioned at either side of the zone II. The inlets 9 each have a nozzle, inlet tube or the like 10 which is inclined inwards and downwards into the chamber towards the upper edge areas of the bodies and from both sides thereof. The air curtains 12 emanating from the jets 10 have the effect of producing a wedge-shaped zone 4. The curtains of air 12 effectively screen the body sides more strongly than do those from the curtains 7 from the jets 6 alone. The air curtains 12 from the jets 10 are parallel with the path of movement of the products and impinge against air from the part of the ceiling 3 above the zone II. When there is relatively low pressure within the working zone I,I at the same time as a relatively high pressure exists within the zone II, the curtains of air 12 from the jets 10 can become curved, as indicated in dash lines, outwards and downwards as the angle between the boundary curtains of air 12 from each jet 10 is reduced. Further, the outlet zones between the bodies are also effectively made narrower, and the pressure in the zone II increases and the exit air speed increases.

In addition by changing the angle and/or discharge velocity of the jets 10 the curtains 12 can be rendered more effective in increasing the air speed between the products and providing some lateral air curtaining in zone II. It will be understood that the jets 6 and/or 10 may be pivotably or otherwise movably mounted to alter their respective directions of throw. Further, the jets 6 and 10 may be designed for control of their air discharge velocity.

The jets 6 and 10 may be used individually or in combination.

It is possible to maintain the air temperate in the zones I,I and II at different temperatures and even to regulate the respective degree of humidity. Also required or desired additives can be added to the air for the zone II for enhancing the spray painting process.

Also to reduce the speed of inflow of the air to the zones I,I there may be means for reducing the flow mounted within the areas of the ceiling sections above the zones I,I. The means may comprise separate controllable air supply systems from external equipment (not shown). The means can also comprise filter mats 11 which also act to free the air of dust.

It will be understood that the filter mats 11 can be arranged across the entire ceiling 3 so that the air to all the spaces I,I, and II is filtered. Moreover, if it is desired to effect a greater flow reduction of air to a particular zone or zones for example to the working zones I,I, the filter mats above these zones can be made extra thick or of material which offers greater resistance to the passage of the air.

Jets can also be mounted in the booth for providing transverse curtains of air in addition to the curtains 7 and 12. The jets would be similar to those providing the curtain 7 and 12. Such transverse curtains between the products prevent the cross-contamination of for example different colours.

Furthermore traversable transverse curtains of air can be arranged to be synchronously movable with the conveyor or bodies and for example be arranged in synchronism with the conveyor which transports the bodies through the booth.

The longitudinal curtains of air 7 may be arranged not to touch the bodies directly. In this way high speeds are avoided in the immediate vicinity of the bodies, which is of importance for example when electrostatic application of paints is being carried out. If the longitudinal curtains of air are moved slightly laterally away from the bodies the basic effect of the increase of air speed between the bodies is nevertheless maintained.

Movable or stationary paint applicators are used for example at electrostatic coating systems. It is an advantage to arrange air curtains at such coating devices. The air curtain devices with nozzle banks or the like will be located parallel or at an angle to the discharge direction of the coating application device. This arrangement will control the undesirable spread of coating material during painting or cleaning with a cleaning agent and prevent drifting and eddying of paint or thinner.

It will be understood that it is not necessary to have a single zone II and two working zones I,I located longitudinally. If so desired there may be one longitudinal zone I and one longitudinal zone II. Furthermore there can be a multiplicity of alternate zones I,II,I,II etc.

In every embodiment, the curtains of air function as guards for the paint streams mists, fumes dust etc. as from product to product and operator to product. These streams which have a high speed are led away by the curtains of air to the air exit from the booth so that unwanted cross-contamination between products in zones II cannot occur.

Tests with a booth described with reference to the drawing have shown that large savings of energy can be made, while at the same time the working conditions for the personnel are improved and a controlled regulation of ventilation of different zones can occur. There are thus economic, technical and environmental improvements.

What we claim is:

1. In a process for ventilating a station for the surface treatment of spaced-apart successive objects arriving sequentially at said station, by passing inlet ventilating air downward through said station and about said objects from inlets in a ceiling above said station, removing said ventilating air by way of outlets in a floor below the level of the objects, and dividing the interior of said station into a first zone adjacent each said successive object and at least a pair of other zones more remote from said each object by means of a pair of curtains of air moving at a velocity higher than that of said ventilating air and disposed generally adjacent opposite sides of said object, the improvement wherein said curtains are directed convergently downward so that said flow of said ventilating air in said first zone converges downwardly, whereby the outflow of said ventilating air from said one zone is principally by way of the spacing between said objects and at relatively high velocity.

2. The method of claim 1, wherein the velocity of said ventilating air into said first zone, and the consequent air pressure in said first zone, is greater than that in said other zones.

3. The method of claim 2, wherein the velocity of said ventilating air entering said first zone is about 0.5 meters per second.

4. The method of claim 2, wherein the velocity of said ventilating air entering said other zones is about 0.15 to 0.2 meters per second.

5. The method of claim 1, in which said curtains of air are spaced laterally from said each object, so as to provide a region of low air speed around each object.

6. The method of claim 1, wherein said curtains extend transversely between successive ones of said objects.

7. The method of claim 6, comprising moving said transversely extending curtains and said objects at the same speed through said station.

* * * * *